US005870704A

United States Patent [19]

Laroche

[11] Patent Number: 5,870,704

[45] Date of Patent: Feb. 9, 1999

[54] FREQUENCY-DOMAIN SPECTRAL ENVELOPE ESTIMATION FOR MONOPHONIC AND POLYPHONIC SIGNALS

[75] Inventor: Jean Laroche, Aptos, Calif.

[73] Assignee: Creative Technology Ltd., Singapore

[21] Appl. No.: 745,930

[22] Filed: Nov. 7, 1996

[51] Int. Cl.[6] ..... G10L 9/04

[52] U.S. Cl. ..... 704/209; 704/224

[58] Field of Search ..... 704/205–209, 704/231, 224, 246, 249, 254, 265; 84/610

[56] References Cited

U.S. PATENT DOCUMENTS

| | | | |
|---|---|---|---|
| 3,649,765 | 3/1972 | Rabiner et al. | 704/209 |
| 3,982,070 | 9/1976 | Flanagan | 704/265 |
| 4,051,331 | 9/1977 | Strong et al. | 381/68 |
| 4,246,617 | 1/1981 | Portnoff | 360/32 |
| 4,384,335 | 5/1983 | Duifhuis et al. | 704/207 |
| 4,559,602 | 12/1985 | Bates, Jr. | 364/487 |
| 4,809,332 | 2/1989 | Jongman et al. | 704/231 |
| 4,829,574 | 5/1989 | Dewhurst et al. | 704/236 |
| 4,856,068 | 8/1989 | Quatieri, Jr. et al. | 704/227 |
| 4,885,790 | 12/1989 | McAulay et al. | 704/265 |
| 5,504,832 | 4/1996 | Taguchi | 704/201 |
| 5,504,833 | 4/1996 | George et al. | 704/211 |
| 5,536,902 | 7/1996 | Serra et al. | 84/623 |
| 5,712,437 | 1/1998 | Kageyama | 84/610 |

OTHER PUBLICATIONS

M. Dolson, "The phase vocoder," a tutorial, *Computer Music J.*, 10(4), pp. 14–27.

J.L. Flanagan and R.M. Golden, "Phase vocoder," *Bell Syst. Tech. J.*, pp. 1493–1509, (Nov. 1966).

E. Moulines and J. Laroche, "Non Parametric Techniques for Pitch–Scale Modification of Speech," *Speech Communication*, 16, pp. 175–205, (Feb. 1995).

M.R. Portnoff, "Implementation of the Digital Phase Vocoder Using the Fast Fourier Transform," *IEEE Trans. Acoust., Speech, Signal Processing*, pp. 243–248, (Jun. 1976).

R. Portnoff, "Short–time Fourier Analysis of Sampled Speech," *IEEE Trans. Acoust., Speech, Signal Processing*, pp. 364–373.

R. Portnoff, "Time–Scale Modifications of Speech Based on Short–Time Fourier Analysis," *IEEE Trans. Acoust., Speech, Signal Processing*, pp. 374–390.

James L. Flanagan, Speech Analysis, Synthesis and Perception, Springer–Verlag, New York, 1972, pp. 167–172.

Leo L. Beranek, Acoustics, McGraw–Hill Book Company, Inc., New York, Toronto, London, 1954, pp. 392–396 and 402–406.

Thomas W. Parsons, Voice and Speech Processing, McGraw–Hill, Inc., New York, 1987, pp. 219–222.

Lawrence R. Rabiner & Ronald W. Schafer, Digital Processing of Speech Signals, Prentice Hall, New Jersey, 1978, pp. 158–161.

Daniel N. Lapedes, McGraw–Hill Dictionary of Physics and Mathematics, McGraw–Hill Book Company, NY, 1978, p. 1053.

*Primary Examiner*—David D. Knepper

*Attorney, Agent, or Firm*—Townsend & Townsend & Crew

[57] ABSTRACT

Estimating the time-varying spectrum envelope of a time-varying signal facilitates pitch modification and other shifting of signal content in the frequency domain. Local maxima of a spectrum of the signal are identified by applying a masking curve. The masking curve has a peak at the particular maximum and descends away therefrom the local maximum. Local maxima falling below the local maximum are eliminated. The slope of the masking curve is varied in accordance with measured parameters of the spectrum to decrease or eliminate spurious peaks. Thereafter, a smoothing procedure may be applied to smooth the spectrum in frequency.

19 Claims, 5 Drawing Sheets

FREQUENCY-DOMAIN SPECTRAL ENVELOPE ESTIMATION FOR MONOPHONIC AND POLYPHONIC SIGNALS

COPYRIGHT NOTICE

A portion of the disclosure of this patent document contains material which is subject to copyright protection. The copyright owner has no objection to the xeroxographic reproduction by anyone of the patent document or the patent disclosure in exactly the form it appears in the Patent and Trademark Office patent file or records, but otherwise reserves all copyright rights whatsoever.

SOURCE CODE APPENDIX

A source code appendix is included herewith.

BACKGROUND OF THE INVENTION

The present invention relates to signal analysis and in certain embodiments to spectral envelope estimation from a series of short-time Fourier transforms.

Many signal processing applications require shifting of signal content in the frequency domain. One example is format modification of a signal to turn a female voice into a male voice or vice versa.

Previous methods of pitch modification, for example, assume that the signal is monophonic, as opposed to polyphonic, and that its pitch has been estimated. This restricts the methods to the narrow subset of potential applications dealing with monophonic, pitch-defined, signals such as voice, monophonic instruments and so on. To process polyphonic signals, it would be useful to obtain a time-varying spectral envelope which highlights multiple pitches and facilitates modification of the multiple pitches.

SUMMARY OF THE INVENTION

The present invention provides a high quality estimation of a time-varying spectrum envelope of a time-varying signal to facilitate pitch modification and other shifting of signal content in the frequency domain for both polyphonic and monophonic signals. The signal need not be periodic or quasi-periodic or be the sum of periodic or quasi-periodic signals.

In accordance with a first aspect of the present invention, a method for estimating a spectral envelope of a signal includes steps of registering a spectrum of the signal, identifying local maxima of the spectrum, and applying a masking curve to a particular local maximum of the local maxima. The masking curve has a peak at the particular maximum and descends away from the local maximum. The local maxima falling below the local maximum are eliminated.

In accordance with a second aspect of the present invention, the above spectral envelope estimation procedure iterates by varying slope away from the local maximum. If the cumulative magnitude increase is lower than a threshold, the slope is decreased to eliminate spurious peaks. Once this iterative process is complete, a smoothing procedure may be applied to smooth the spectrum in frequency.

In accordance with a third aspect of the present invention, the above spectral envelope estimation procedure is repeated over time for a time-varying signal. The obtained spectral envelopes are smoothed in the time domain using a signal dependent smoothing factor.

A further understanding of the nature and advantages of the invention herein may be realized by reference to the remaining portions of the specification and the attached drawings.

DESCRIPTION OF SPECIFIC EMBODIMENTS

Figure 1:
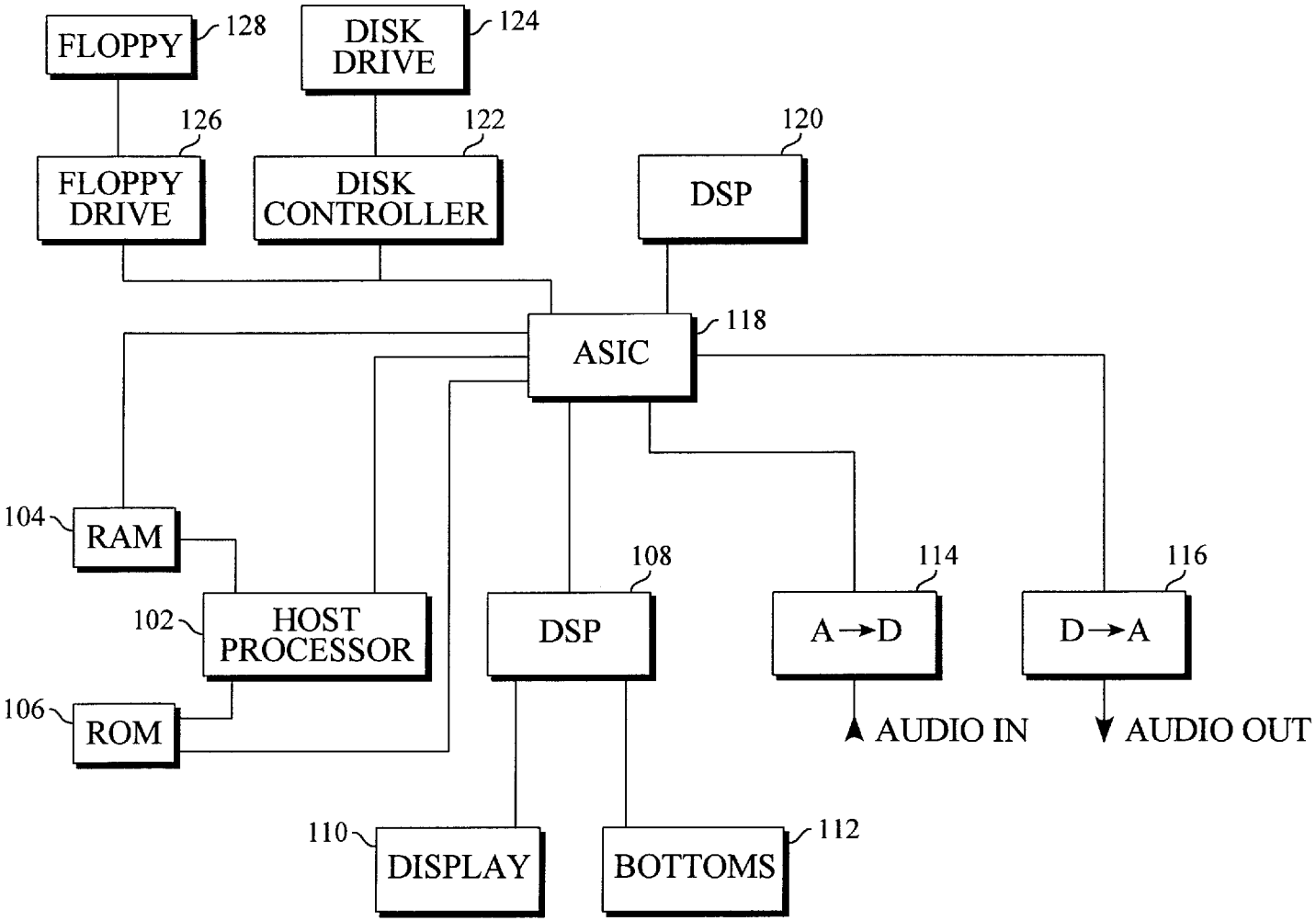
FIG. 1 depicts a signal processing system suitable for implementing the present invention.

FIG. 1 depicts a signal processing system 100 suitable for implementing the present invention. In one embodiment, signal processing system 100 captures sound samples, processes the sound samples in the time and/or frequency domain, and plays out the processed sound samples. The present invention is, however, not limited to processing of sound samples but also may find application in processing, e.g., video signals, remote sensing data, geophysical data, etc. One particular application of signal processing system 100 is pitch modification of polyphonic sounds such as voice ensembles or multiple instrument music. Signal processing system 100 includes a host processor 102, RAM 104, ROM 106, an interface controller 108, a display 110, a set of buttons 112, an analog-to-digital (A-D) converter 114, a digital-to-analog (D-A) converter 116, an application-specific integrated circuit (ASIC) 118, a digital signal processor 120, a disk controller 122, a hard disk drive 124, and a floppy drive 126.

In operation, A-D converter 114 converts analog sound signals to digital samples. Signal processing operations on the sound samples may be performed by host processor 102 or digital signal processor 120. Sound samples may be stored on hard disk drive 124 under the direction of disk controller 122. A user may request particular signal processing operation using button set 112 and may view system status on display 110. Once sounds have been processed, they may be played out by using to D-A converter 116 to convert them back to analog. The program control information for host processor 102 and DSP 120 is operably disposed in RAM 104. Long term storage of control information may be in ROM 106, on disk drive 124 or on a floppy disk 128 insertable in floppy drive 126. ASIC 118 serves to interconnect and buffer between the various operational units. DSP 120 is preferably a 50 MHz TMS320C32 available from Texas Instruments. Host processor 102 is preferably a 68030 microprocessor available from Motorola.

In accordance with one embodiment of the present invention, spectral envelope estimation is one application of signal processing system 100. Before spectral envelope estimation begins, digital signal processing circuit 120 computes a series of short-time Fourier transforms of a sound signal to be analyzed. For this purpose, the signal is decomposed into overlapping frames weighted by an analysis window. A Fourier transform is then applied on each frame, yielding a series of short-time spectral representations of the signal.

The details of short-time Fourier spectral analysis/synthesis are audio signal processing in general are described in the following U.S. patents and other references.

U.S. Pat. Nos. 3,982,070, 4,051,331, 4,246,617, 4,559,602, 4,829,574, 4,856,068, 4,885,790, 5,504,832, 5,504,833, and 5,536,902.

M. Dolson, "The phase vocoder," a tutorial, *Computer Music J.*, 10(4), pp. 14–27.

J. L. Flanagan and R. M. Golden, "Phase vocoder," *Bell Syst. Tech. J.*, pp. 1493–1509, (Nov. 1966).

E. Moulines and J. Laroche, "Non Parametric Techniques for Pitch-Scale Modification of Speech," *Speech Communication*, 16, pp. 175–205, (Feb. 1995).

M. R. Portnoff, "Implementation of the Digital Phase Vocoder Using the Fast Fourier Transform," *IEEE Trans. Acoust., Speech. Signal Processing*, pp. 243–248, (June 1976).

R. Portnoff, "Short-time Fourier Analysis of Sampled Speech," *IEEE Trans. Acoust., Speech, Signal Processing,* pp. 364–373.

R. Portnoff, "Time-Scale Modifications of Speech Based on Short-Time Fourier Analysis," *IEEE Trans. Acoust., Speech. Signal Processing*, pp. 374–390.

Figure 2:
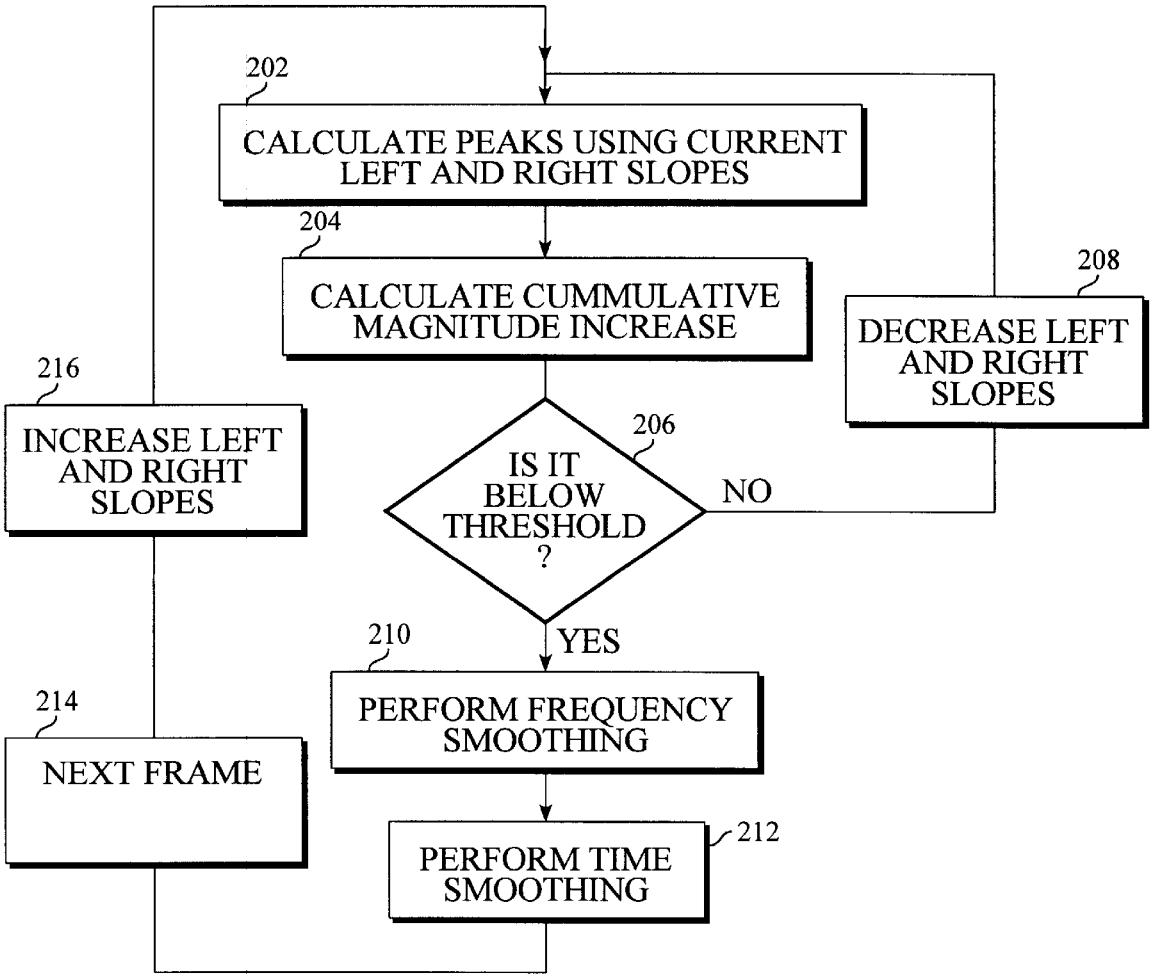
FIG. 2 depicts a top-level flowchart describing steps of spectral envelope estimation in accordance with one embodiment of the present invention.

FIG. 2 depicts a top-level flowchart describing steps of spectral envelope estimation in accordance with one embodiment of the present invention. The preferred embodiment determines the peaks in the first short-time Fourier transform of the series. Peaks are local maxima, frequency values having a higher magnitude level than their neighbors. At step 202, the preferred embodiment applies masking curves with a defined slope to each of the peaks to eliminate possible spurious peaks. A line or curve extends left and right from each peak with the defined slope. Peaks falling underneath either line or curve are deemed to be spurious and eliminated. Only principle local maxima remain.

Figure 3:
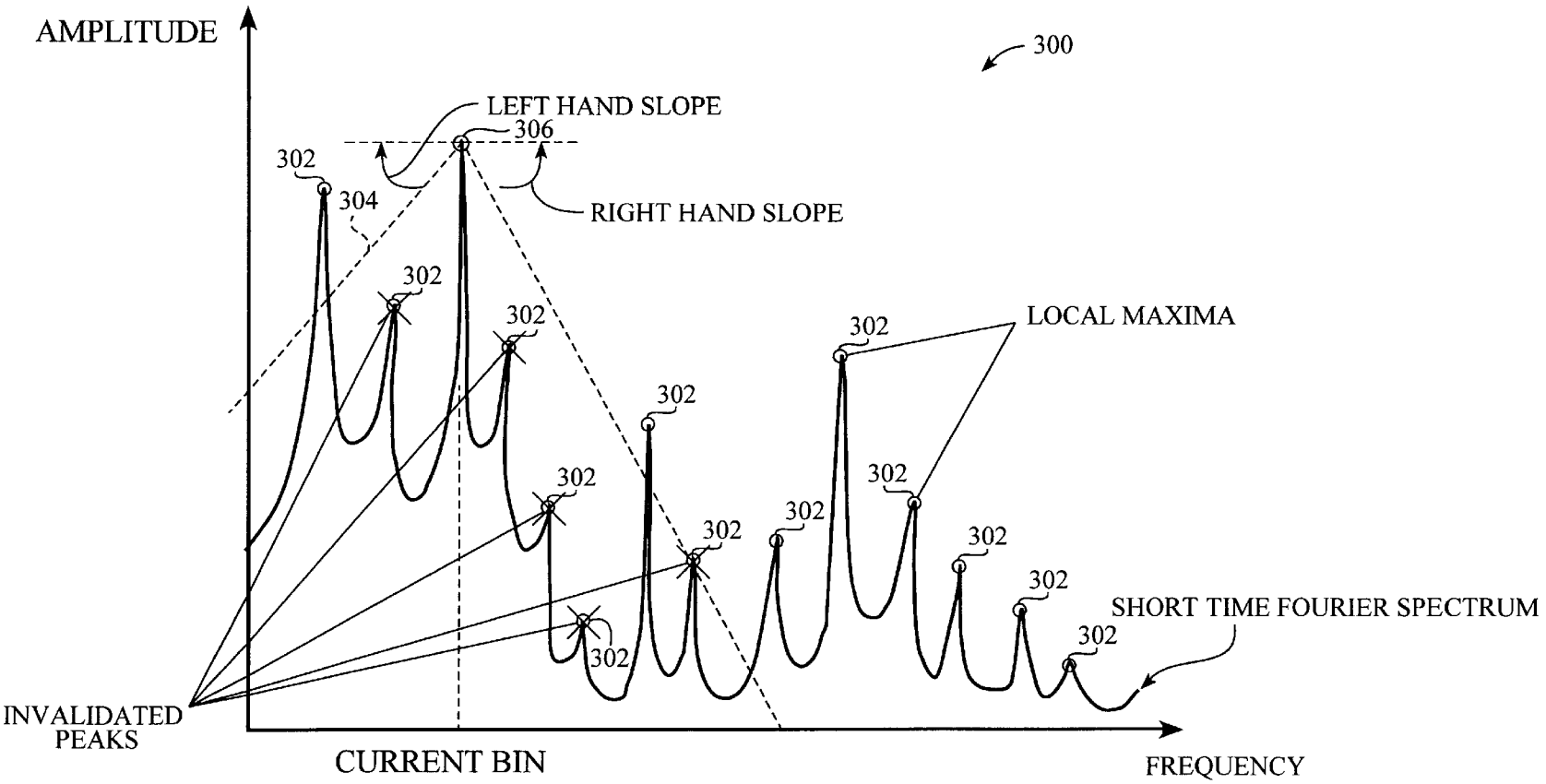
FIG. 3 illustrates the application of a masking curve to eliminate invalid peaks in accordance with one embodiment of the present invention.

FIG. 3 illustrates this process in the form of a graph 300 of a particular short-time spectrum. Local maxima 302 are the peaks of the spectrum. A masking curve 304 is being applied to a particular local maximum 306. Certain peaks marked with an "x" are eliminated because they fall underneath masking curve 304. Masking curve 304 preferably includes two straight lines, but the present invention is not so limited.

Once possible spurious peaks are eliminated in this way, a cumulative magnitude increase for the spectrum is computed at step 204. Starting with the peak of lowest frequency, the magnitude difference between that peak and the next peak is calculated in decibels. If the next peak is higher than the current peak, the magnitude difference is added to a cumulative magnitude increase estimator C. If the next peak is not higher than the current peak, the cumulative magnitude increase is left unmodified. This procedure is repeated for the next peak, until the last peak is reached. Accordingly, $$C = \sum_{k=0}^{K} \max(0, P(k+1) - P(k))$$

where P(k) represents the amplitude of the kth peak expressed in dB.

Figure 4:
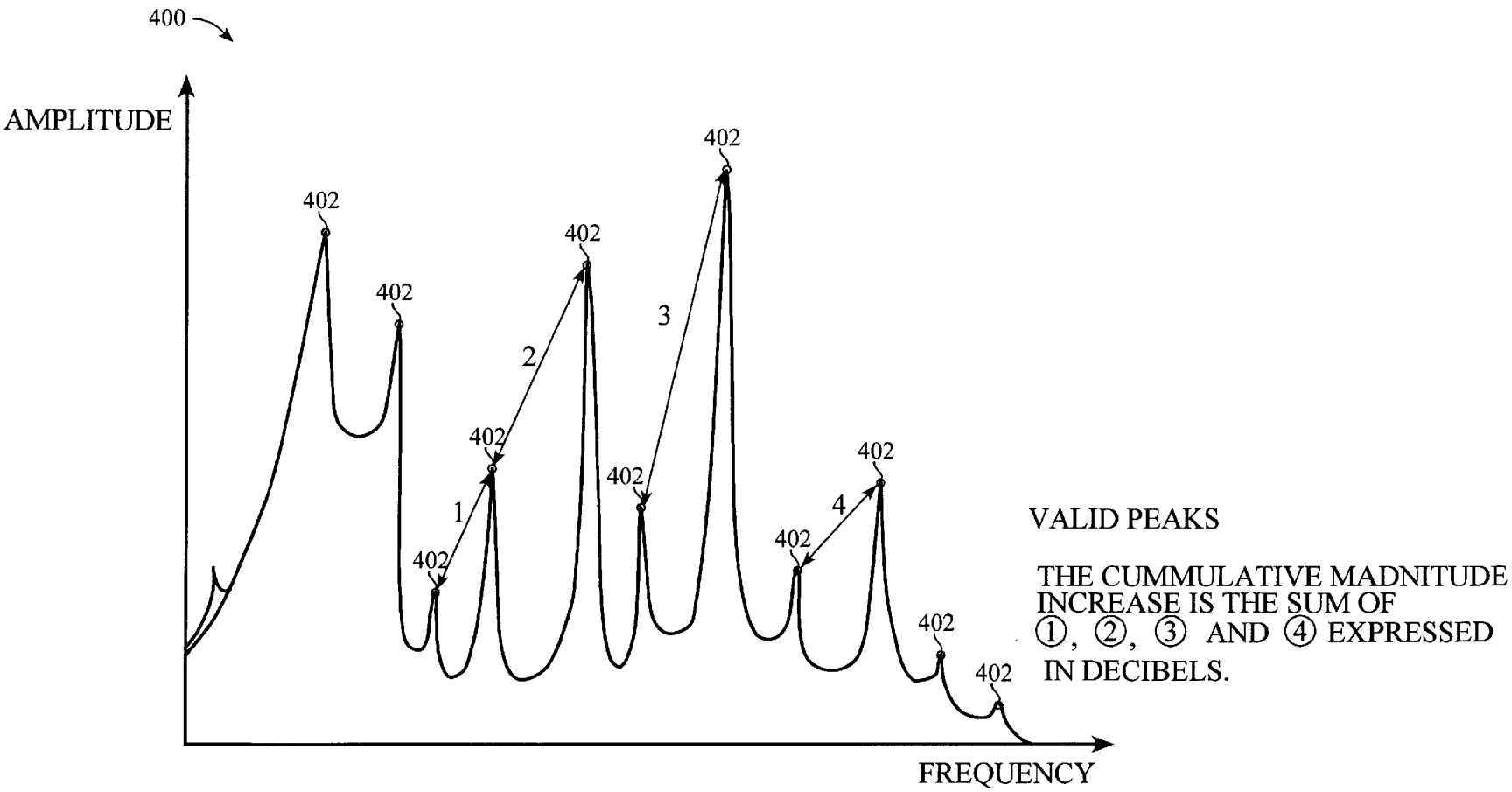
FIG. 4 illustrates estimating a cumulative magnitude increase for a spectral envelope in accordance with one embodiment of the present invention.

FIG. 4 illustrates the magnitude differences that are accumulated to contribute to the cumulative magnitude increase. A graph 400 shows valid peaks 402 of the spectrum of FIG. 3. The pairings of peaks contributing to the cumulative magnitude increase are marked "1", "2", "3", "4".

At step 206, C is compared to a threshold. If C is greater than the threshold, this suggests that spurious peaks remain. The defined slope values are decreased at step 208. The peak elimination process is restarted at step 202. The previously eliminated peaks are considered again, although they are likely to be eliminated again. If C is less than the threshold, the determination of which peaks are spurious is validated and processing continues at step 210.

At step 210, frequency smoothing is applied to the spectrum that has had its spurious peaks eliminated. Each peak is compared to its right and left neighbors. If the magnitude of the peak is lower than both of its neighbors, then it is adjusted to a weighted average (in dB) of its neighbors' amplitudes.

$$P(k)=\alpha P(k-1)+\beta P(k)+\gamma P(k+1) \text{ if } P(k)<P(k-1) \text{ and } P(k)<P(k+1)$$

where P(k) represents the current peak's amplitude, expressed in dB, P(k−1) and. P(k+1) the amplitudes of the next peak to the left and to the right. $\alpha$, $\beta$, and $\gamma$ are weighting factors whose sum must be $\alpha+\beta+\gamma=1$. From the frequency smoothed series of spectral peaks, a spectral envelope is generated by linking successive peaks with linear segments. These segments may be linear in terms of either dB or linear amplitude.

At step 212, time smoothing is applied to the spectral envelope as compared to previous spectral envelopes. A time domain signal is formed by the values of the spectral envelope at a given frequency corresponding to successive short-time Fourier transforms. These time domain signals are subject to low-pass filtering at step 212.

Figure 5:
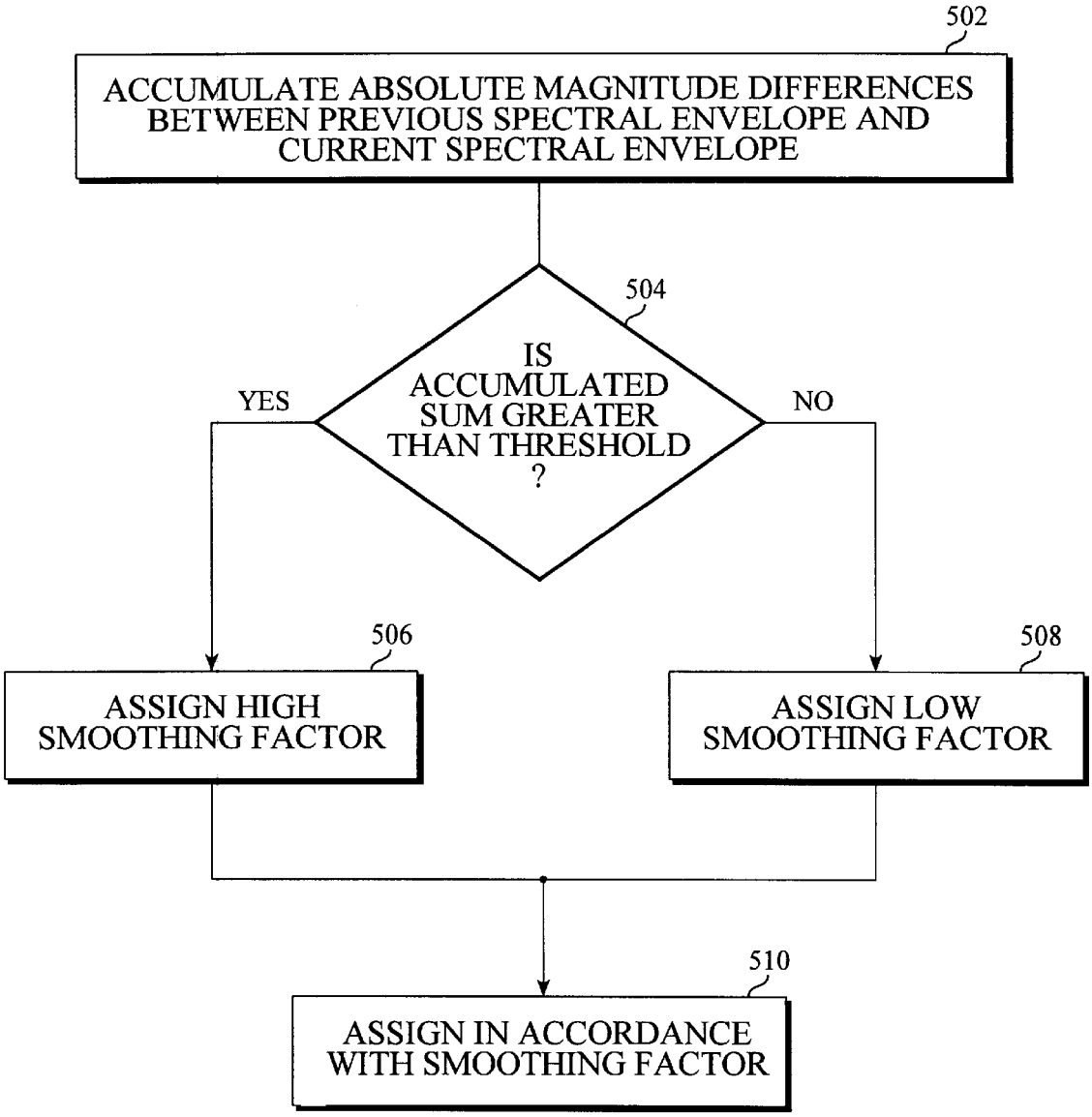
FIG. 5 depicts a flowchart describing steps of smoothing a spectral envelope estimate in the time domain in accordance with one embodiment for the present invention.

The details of step 212 are described with reference to FIG. 5. At step 502, the preferred embodiment accumulates the differences in absolute magnitude between the current envelope and the preceding envelope over all frequencies. The preceding envelope has already been smoothed. The accumulated sum given by, $$Q = \sum_{\omega=0}^{\pi} |S_n(\omega) - \hat{S}_{n-1}(\omega)|$$

where S and $\hat{S}$ are expressed in dB. In an alternative embodiment, the accumulated sum is given by:

$$Q' = \left[ \sum_{\omega=0}^{\pi} W(\omega)|S_n(\omega) - S_{n-1}(\omega)|^m \right]^{\frac{1}{m}}$$

where $W(\omega)$ is a weighting factor and m is an integer. At step 504, the accumulated sum Q is compared to a threshold. If Q is less than a threshold, a smoothing factor $\mu$ is given a value close to 1 to indicate a weak smoothing effect at step 506. If Q is greater than the threshold, the smoothing factor $\mu$ is assigned a value close to zero to indicate a strong smoothing effect at step 508. After either step 506 or step 508, processing proceeds to step 510.

At step 510, assuming $\mu S_n(\omega)$ is the local spectral envelope at time n and at frequency $\omega$, the smoothed spectral envelope at time n is given by $$\hat{S}_n(\omega)=\mu S_n(\omega)(1-\mu)\hat{S}_{n-1}(\omega)$$

By making the smoothing factor $\mu$ signal dependent in this way, signals that change slowly are subject to a large amount of smoothing to eliminate spurious effects while signals that change rapidly are not smoothed to the extent that information is lost. It will be appreciated that step 212 is not executed in the first iteration, since the time-domain smoothing procedure requires a previously smoothed envelope.

At step 214, processing proceeds to the next frame or spectral envelope of the series. At step 216, the slope values used in the masking procedure of step 202 are adjusted upwards to prevent removal of actual peaks as opposed to spurious peaks. The steps of FIG. 2 are repeated for every successive short-time Fourier transform. The result is a series of spectral envelope estimates useful in pitch shifting, time scaling and other applications.

Source code written in the C language for implementing elements of the present invention is included in the appendix included herewith. After compilation and linking using software available from Texas Instruments, the source code will run on the TMS320C32 digital signal processor.

The above description is illustrative and not restrictive. Many variations of the invention will become apparent to those of skill in the art upon review of this disclosure. Merely by way of example, while the invention has been illustrated primarily with regard to a signal processing system, a conventional computer system could also be utilized. The scope of the invention should, therefore, be determined not with reference to the above description, but instead should be determined with reference to the appended claims along with their full scope of equivalents.

Attorney Docket No. 017002-007400US

SOURCE CODE APPENDIX

FREQUENCY-DOMAIN SPECTRAL ENVELOPE
ESTIMATION FOR MONOPHONIC AND POLYPHONIC SIGNALS

Copyright (c) 1996
E-mu Systems Proprietary All rights Reserved

```
/* Envelope( ) estimate an envelope curve based on an array of FFT magnitudes.
 * Input parameters:
 * PeakMagsBase      : An array where the peak magnitudes are stored;
 * PeakLocsBase      : An array where the peak indexes are stored;
 * EnvBase           : An array containing the calculated envelope;
 * MagBase           : An array containing the FFT magnitudes;
 * FFTSize           : The size of the FFT.
 */
void Envelope(float* PeakMagsBase, int* PeakLocsBase, float* EnvBase,
float* MagBase, int FFTSize)
{
int i, NIteration, PeakCount, FFTSizeOverTwo, CurrentPeakLoc;
float Slope, Threshold, LastMagnitude, CurrentPeak, Delta, LocalEnv;
float Num, TotUpdB;
float Magnitude, DEnv;
int *PeakLocsPntr;
float *PeakMagsPntr, *MagPntr, *EnvPntr;
static float SlopeMemory = 0.15;
static float MemFactor = 0.8;
    FFTSizeOverTwo = FFTSize / 2;
/* Find peaks. */
    Slope = SlopeMemory;
    for(NIteration = 0; NIteration < 2; NIteration++)
    {
        if(Slope < .03)
            Slope = .03;
        Slope = Slope;
        PeakMagsPntr = PeakMagsBase;
        PeakLocsPntr = PeakLocsBase;
        PeakCount = 0;
        Threshold = 0.;
        LastMagnitude = 0;
        PeakCount = 1;
        *PeakMagsPntr++ = 1.e20;        /* First bin is a peak */
        *PeakLocsPntr++ = 0;
        MagPntr = MagBase+1;
        for (i = 1; i <= FFTSizeOverTwo; i++)
        {
            Magnitude = *MagPntr++;
            if (Magnitude > Threshold * Threshold * LastMagnitude)
            {
                /* Eliminate previous peaks if not big enough */
                Threshold = 1. - (i - *(PeakLocsPntr = 1)) * Slope;
                while ( Magnitude * Threshold * Threshold >
                                    *(PeakMagsPntr - 1) )
                {
                    PeakCount--;
                    PeakMagsPntr--;
                    PeakLocsPntr--;
                    Threshold = 1. - (i - *(PeakLocsPntr-1)) * Slo
pe;
                    if (Threshold < 0)
```

-continued

Attorney Docket No. 017002-007400US

SOURCE CODE APPENDIX

FREQUENCY-DOMAIN SPECTRAL ENVELOPE
ESTIMATION FOR MONOPHONIC AND POLYPHONIC SIGNALS

Copyright (c) 1996
E-mu Systems Proprietary All rights Reserved

```
                    break;
                }
                PeakCount++;
                PeakMagsPntr++ = LastMagnitude = Magnitude;
                *PeakLocsPntr++ = i;
                Threshold = 1;
            }
            else
ue is under shade */
            {
                Threshold -= Slope;
                    /* Decrease shade */
                if (Threshold < 0)
                    Threshold = 0;
            }
        }
        /* Final Check: If the envelope dips too much, there's something wrong
         * Add up in dBs the positive amplitude variations from one peak to th
e
         * next, if it exceeds a threshold, we need to reestimate the envelope
         */
        /* Search for 1st descending amplitude (skip low-freq gap) */
        for (i=1;i<PeakCount-1;i++)
            if(PeakMagsBase[i+1] < PeakMagsBase[i]) break;
        for(Num = 1;i<PeakCount-1;i++)
        {
            if(PeakMagsBase[i] < PeakMagsBase[i+1])
              Num *= PeakMagsBase[i+1]/PeakMagsBase[i], i++;
        }
        TotUpdB = 10*log10(Num);
        if(i==1) i = 2;
        /* If TotUpdB is too large, we need to recalculate the envelope */
        if(Slope > .03 && TotUpdB > 80)
        {
            if(TotUpdB > 150)
                Slope /= 1.5;
            else if(TotUpdB > 100)
                Slope /= 1.3;
            else Slope /= 1.2;
        }
        /* Envelope looks correct, no need to iterate */
        else break;
    }
    /* This is to make sure we can go back down to low pitches. */
    Slope += 0.002;
    if(Slope > .15)
        Slope = .15;
    SlopeMemory = Slope;
    /* Final frequency envelope smoothing. We only "fill-in"
     * valleys, don't touch peaks.
     */
    for(i=2;i<PeakCount-2;i++)
    {
        if(PeakMagsBase[i] < PeakMagsBase[i+1] &&
            PeakMagsBase[i] < PeakMagsBase[i-1])
        PeakMagsBase[i] = pow(PeakMagsBase[i-1] *
            PeakMagsBase[i] * PeakMagsBase[i+1], 1/3.);
    }
    /*__________END OF PEAK PICKING __________/*
    PeakMagsBase[0] = PeakMagsBase[1];
    PeakMagsBase[PeakCount] = PeakMagsBase[PeakCount-1];
    PeakLocsBase[PeakCount] = FFTSizeOverTwo;
/* Compute spectral envelope. */
    EnvPntr = EnvBase;
    PeakMagsPntr = PeakMagsBase;
    PeakLocsPntr = PeakLocsBase;
    *PeakMagsPntr = sqrt(*PeakMagsPntr);
    for (i = 0, DEnv = 0; i < FFTSizeOverTwo; i++)
    {
        if (i == *PeakLocsPntr)
```

-continued

Attorney Docket No. 017002-007400US

SOURCE CODE APPENDIX

FREQUENCY-DOMAIN SPECTRAL ENVELOPE ESTIMATION FOR MONOPHONIC AND POLYPHONIC SIGNALS

Copyright (c) 1996
E-mu Systems Proprietary All rights Reserved

```
        {
            CurrentPeak = *PeakMagsPntr++;
            *PeakMagsPntr = sqrt(*PeakMagsPntr);
            CurrentPeakLoc = *PeakLocsPntr++;
            Delta = (PeakMagsPntr - CurrentPeak) /
                        (*PeakLocsPntr - CurrentPeakLoc);
        }
        LocalEnv = CurrentPeak + Delta * (i - CurrentPeakLoc);
    /* Add to the totalizer the abs value of the difference in dB between the
     * previous envelope and the current one.
     */
        if (EnvPntr[i] > 0 && LocalEnv > 0)
        {
            if(EnvPntr[i] > LocalEnv)
                DEnv += log10(EnvPntr[i]/LocalEnv);
            else
                DEnv += log10(LocalEnv/EnvPntr[i]);
        }
        /* Interpolate envelope between peaks */
        EnvPntr[i] = (1 - MemFactor) * EnvPntr[i] + MemFactor *
            LocalEnv;
    }
    DEnv = 20*DEnv;
    if(DEnv > 3)
        MemFactor = 0.8;
    else MemFactor = 0.1;
}
```

What is claimed is:

1. A method for estimating a spectral envelope of a signal comprising the steps of:

registering a spectrum of said signal;

identifying local maxima of said spectrum, each of which has an amplitude associated therewith;

applying a masking curve having a peak, with said spectrum having a plurality of amplitudes and a slope associated therewith, with one of said local maxima lying in said peak and a subgroup of said local maxima having amplitudes lower than a subset of said plurality of amplitudes associated with said masking curve;

attenuating said subgroup of local maxima; and varying said slope of said masking curve.

2. The method of claim 1 further comprising the step of:

repeating said applying and attenuating steps for each of said local maxima of said spectrum, with remaining local maxima defining principle local maxima.

3. The method of claim 2 further comprising the step of:

accumulating a cumulative magnitude increase across said spectrum after said repeating step.

4. The method of claim 3 said varying step of occurs after said registering, said identifying, said applying, said repeating and said accumulating steps had been repeated.

5. The method of claim 4 wherein said varying step reduces said cumulative magnitude and further comprising the step of:

smoothing said spectrum after said cumulative magnitude increase falls below a threshold.

6. The method of claim 5 wherein said smoothing step comprises the steps of:

comparing each local maximum in said spectrum to its neighbors; and if a magnitude of said local maximum is lower than magnitudes of both neighbors, adjusting said local maximum to be a weighted average of said neighbors.

7. The method of claim 6 wherein said weighted average, $$P(k)=\alpha P(k-1)+\beta P(k)+\gamma P(k+1) \text{ if } P(k)<P(k-1) \text{ and } P(k)<P(k+1)$$

, wherein $\alpha$, $\beta$, and $\gamma$ are weighing factors whose sum is $\alpha+\beta+\gamma=1$.

8. The method of claim 7 further comprising the step of:

estimating said spectral envelope by linking successive remaining peaks with linear segments.

9. The method of claim 8 further comprising the step of:

repeating said registering, said identifying, said applying, said repeating, said accumulating, said smoothing and said estimating steps for successive time windows of said signal to develop a series of spectral envelopes.

10. The method of claim 9 wherein said successive time windows overlap.

11. The method of claim 8 further comprising the step of:

applying a smoothing operation to said spectral envelope.

12. The method of claim 11, wherein $\mu S_n(\omega)$ is a spectral envelope value at time n and at frequency $\omega$, the smoothed spectral envelope at time n being given by $$\hat{S}_n(\omega)=\mu S_n(\omega)+(1-\mu)\hat{S}_{n-1}(\omega).$$

13. The method of claim 11 wherein said smoothing step comprises smoothing in accordance with a smoothing factor.

14. The method of claim 13 wherein said smoothing factor is signal dependent to smooth a rapidly changing series of spectral envelopes less and a slowly changing series of spectral envelopes more.

15. The method of claim 14 wherein said smoothing step comprises varying said smoothing factor in accordance with steps comprising:

accumulating over a plurality of frequencies, a sum of absolute magnitude differences between said spectral envelope and an immediately previous spectral envelope in a series;

comparing said sum to a threshold; and if said threshold is exceeded, applying a smoothing factor that will smooth less than a smoothing factor applied if said threshold is not exceeded.

16. A method for smoothing a series of spectral envelopes corresponding to time windows of a signal, comprising:

smoothing said series in accordance with a smoothing factor, wherein said smoothing factor is varied in accordance with the following steps:

for a selected spectral envelope of said series, accumulating over a plurality of frequencies, a sum of absolute magnitude differences between said selected spectral envelope and an immediately previous spectral envelopes;

comparing said sum to a threshold; and if said threshold is exceeded, applying a smoothing factor that will smooth less than a smoothing factor applied if said threshold is not exceeded.

17. The method of claim 16 wherein $\mu S_n(\omega)$ is a spectral envelope value at time n and at frequency ω, said smoothing factor being $\mu$ the smoothed spectral envelope at time n being smoothed to $$\hat{S}_n(\omega)=\mu S_n(\omega)+(1-\mu)\hat{S}_{n-1}(\omega).$$

18. A signal processing system comprising:

memory that stores a digital representation of a signal and code for registering a spectrum of said signal;

code for identifying local maxima of said spectrum; and code for applying a masking curve to a particular local maximum of said local maxima, said masking curve having a peak at said particular maximum and descending to the left and to the right of said local maximum with a defined slope, wherein local maxima falling below said local maximum are eliminated;

code for varying said slope; and a processor executing said code stored in said memory.

19. A computer program product comprising code for registering a spectrum of said signal;

code for identifying local maxima of said spectrum; and code for applying a masking curve to a particular local maximum of said local maxima, said masking curve having a peak at said particular maximum and descending to the left and to the right of said local maximum with a defined slope, wherein local maxima falling below said local maximum are eliminated;

code for varying said slope; and a computer-readable storage medium for storing the codes.

* * * * *